United States Patent [19]

Tanahashi et al.

[11] 4,426,976

[45] Jan. 24, 1984

[54] ENGINE AIR/FUEL RATIO CONTROL SYSTEM INJECTING BLEED AIR INTO BOTH FUEL SYSTEMS OF DOUBLE BARRELED CARBURETOR

[75] Inventors: Toshio Tanahashi; Hidemi Ohnaka; Yasuo Ohmori, all of Susono, Japan

[73] Assignee: Toyota Jidosha Kabushiki Kaisha, Toyota, Japan

[21] Appl. No.: 325,198

[22] Filed: Nov. 27, 1981

[30] Foreign Application Priority Data

Dec. 11, 1980 [JP] Japan ..... 55-178499[U]

[51] Int. Cl.[3] ..... F02M 7/18

[52] U.S. Cl. ..... 123/440

[58] Field of Search ..... 123/438, 440

[56] References Cited

U.S. PATENT DOCUMENTS 4,341,190 7/1982 Ishikawa et al. ..... 123/440 X

*Primary Examiner*—Tony M. Argenbright

*Attorney, Agent, or Firm*—Stevens, Davis, Miller & Mosher

[57] ABSTRACT

An engine includes a double barreled carburetor. A sensor mounted to the exhaust system detects the concentration of a component in the exhaust. A control unit, based on a signal from the sensor, dispatches a control signal to an air bleed control valve to vary its resistance. Primary and secondary path systems lead from the outlet of the air bleed control valve and respectively supply primary bleed air into the fuel which is being supplied into the primary barrel of the carburetor and secondary bleed air into the fuel which is being supplied into the secondary barrel of the carburetor. A one way valve is fitted in the secondary path system so as to allow air flow only towards the secondary barrel, and not away therefrom. Thus, when both barrels are opened, bleed air is sucked in to the primary barrel through the primary path system, and also bleed air is sucked in to the secondary barrel through the secondary path system past the one way valve; but, when only the primary barrel is opened, bleed air is sucked in to the primary barrel through the primary path system, but no bleed air is sucked in to the secondary barrel through the secondary path system, and the one way valve prevents reverse flow of air from the secondary barrel through the secondary path system and thencefrom into the primary path system towards the primary barrel.

4 Claims, 3 Drawing Figures

ENGINE AIR/FUEL RATIO CONTROL SYSTEM INJECTING BLEED AIR INTO BOTH FUEL SYSTEMS OF DOUBLE BARRELED CARBURETOR

BACKGROUND OF THE INVENTION

The present invention relates to the field of air/fuel ratio control devices for internal combustion engines such as those internal combustion engines used for automotive vehicles, and more particularly relates to the field of such air/fuel ratio control devices for internal combustion engines which are equipped with double barreled carburetors in their fuel intake systems and three way catalytic converters in their exhaust systems.

Three way catalytic converters for internal combustion engines are per se well known in various different forms. Such a three way catalytic converter is capable of converting HC, CO, and other products of incomplete combustion in the hot exhaust gases of the internal combustion engine into harmless end products by an oxidizing reaction, and also of simultaneously converting nitrogen oxides (so called NOx) in the exhaust gases into harmless end products by a reducing reaction, provided that the air/fuel ratio of the exhaust gases passing into said three way catalytic converter is maintained within a rather narrow range about the stoichiometric condition. If, however, the air/fuel ratio of the exhaust gases passing into said three way catalytic converter wanders towards the lean side of stoichiometric, then although the above detailed oxidizing reaction for converting HC, CO, and other products of incomplete combustion in the hot exhaust gases of the internal combustion engine into harmless end products continues, the reducing reaction for converting nitrogen oxides in the exhaust gases into harmless end products will substantially cease; and, if the air/fuel ratio of the exhaust gases passing into said catalytic converter wanders towards the rich side of stoichiometric, then although the reducing reaction for converting nitrogen oxides in the exhaust gases of the internal combustion engine into harmless end products continues, the oxidizing reaction for converting HC, CO, and other products of incomplete combustion in the hot exhaust gases into harmless end products will substantially cease.

It is possible to control the air/fuel ratio of the exhaust gases passing into the three way catalytic converter within a narrow range about the stoichiometric condition by controlling the air/fuel ratio of the air-fuel mixture being supplied to the internal combustion engine through its intake system within a narrow range about the stoichiometric condition, and therefore conventionally many different sorts of fuel/air ratio control systems have heretofore been proposed which have as their goal maintaining the air/fuel ratio of the air-fuel mixture being supplied to the internal combustion engine close to the stoichiometric condition.

A typical such prior art system has an oxygen sensor fitted to the exhaust manifold of the internal combustion engine, upstream of the three way catalytic converter, so as to sense the presence of oxygen in the exhaust gases therein. The signal from this oxygen sensor is then sent to a device which provides extra air into the intake system of the engine at some point therein. In this case, the basic air/fuel ratio of the air-fuel mixture provided by the carburetor of the internal combustion engine is set to be rather on the rich side of stoichiometric, and thus by addition of a proper amount of extra air to the intake system and air/fuel ratio of the air-fuel mixture provided to the internal combustion engine may be controlled to be substantially the stoichiometric air/fuel ratio. Conventionally, the extra air can either be added directly into the intake manifold of the engine, downstream of the carburetor; but it is better from the point of view of mixing of air and of fuel for the extra air to be provided into a passage of the carburetor as an additional amount of bleed air to be mixed with the fuel being provided by the carburetor, in a per se well known fashion. In either case, by feedback control performed by the extra air control device based upon the signal from the oxygen sensor, the air/fuel ratio of the air-fuel mixture provided into the cylinders of the internal combustion engine can be satisfactorily controlled to be substantially the stoichiometric air/fuel ratio, and thereby the air/fuel ratio of the exhaust gases passing into the three way catalytic converter can be satisfactorily maintained within a narrow range about the stoichiometric condition.

This kind of prior art feedback system is effective in the case of a single barreled carburetor, but in the case of a double barreled carburetor, the use of which is becoming more and more frequent nowadays, certain difficulties tend to arise which will now be outlined.

Such a double barreled type of carburetor is provided with a main or primary air intake passage and fuel supply system and a secondary air intake passage with its own fuel supply system. A primary throttle valve is mounted in the primary air intake passage so as to control its opening amount, and a secondary throttle valve is mounted in the secondary air intake passage so as to control its opening amount. Conventionally the primary throttle valve is opened and closed according to the depression of an accelerator pedal or the like of a vehicle to which the internal combustion engine incorporating the carburetor is fitted, and the secondary throttle valve remains closed until the primary throttle valve is opened to a predetermined throttle opening amount, and then, provided that the intake air flow is greater than a certain predetermined air flow amount, opens progressively as the primary throttle valve opens beyond said predetermined opening amount.

The question therefore arises as to at what place in such a double barreled carburetor with two fuel supply systems the extra bleed air, described above, regulated by the extra air control device based upon the signal from the oxygen sensor, should be injected. A system such as for the primary fuel system of the carburetor to have one bleed air supply system incorporating its own primary extra or bleed air control device and for the secondary fuel system to have its own independent secondary bleed air supply system also incorporating its own secondary extra or bleed air control device (the two systems may of course share the same oxygen sensor in the exhaust system of the engine) would solve this question satisfactorily. In this case, air/fuel ratio control would be performed for both the primary fuel system and also the secondary fuel system independently, and accordingly both the air/fuel ratio of the air-fuel mixture produced by the primary fuel system would be kept within a reasonably small range around the stoichiometric value and also the air/fuel ratio of the air-fuel mixture produced by the secondary fuel system would be kept within a reasonably small range around the stoichiometric value. Further, during transient operating conditions such as quick opening or closing of the primary and secondary throttle valves the deviations from the approximately stoichiometric air/fuel ratio of the air-fuel mixture provided by the primary and secondary fuel systems would not be very great. However, the disadvantages of such a system are that two control devices are necessary, and this causes the amount of mechanism to be large, and the cost and the bulk of the system also becomes excessive.

Further, as a general principle, since in fact the secondary throttle valve is not actually opened very often in normal vehicle operation, it is really rather wasteful to provide a special secondary extra or bleed air control device just for the secondary air bleed control system.

An alternative system that has been practiced in the prior art is, therefore, for the primary fuel system of the carburetor to have a bleed air supply system incorporating a primary bleed air control device, and for air bleeding control to be carried out only on the primary fuel supply system of the carburetor, and not on the secondary fuel supply system at all. This system of course avoids the disadvantages outlined above of high cost and duplication of mechanism, and of course when the primary throttle valve is opened but the secondary throttle valve is not opened the regulation of the amount of bleed air, in the above mentioned feedback manner, is performed properly. However, when both the primary throttle valve is opened and also the secondary throttle valve is opened, because the air/fuel ratio of the air-fuel mixture supplied by the carburetor as a whole must be kept substantially at the stoichiometric value by the above described feedback operation, with air bleeding only being performed into the primary fuel supply system, the air/fuel ratio of the air-fuel mixture supplied by the primary fuel supply system will be substantially higher, i.e. leaner, than stoichiometric, while the air/fuel ratio of the air-fuel mixture supplied by the secondary fuel supply system needs to be maintained less, i.e. richer, than stoichiometric.

Now, provided that the air-fuel mixture which is being produced by the primary fuel supply system is well mixed with the air-fuel mixture which is being produced by the secondary fuel supply system before being distributed between the cylinders of the engine, under normal operating conditions of the engine the system will operate correctly in the feedback manner outlined above. However, when for example the vehicle incorporating the engine is quickly decelerated and the accelerator pedal thereof is released quickly from the above described high load condition in which both the primary throttle valve and also the secondary throttle valve are open, i.e. the secondary throttle valve is quickly closed to its completely closed position and the primary throttle valve is still opening at an opening amount substantially less than the aforementioned predetermined opening amount, then the operation of the secondary fuel supply system, which was supplying air-fuel mixture of air/fuel ratio substantially richer than stoichiometric, stops immediately, but the operation of the primary fuel supply system, which was supplying air-fuel mixture of air/fuel ratio substantially leaner than stoichiometric, continues; and, during the inevitable time delay interval before the above described feedback system brings the opening of the bleed air control valve to the equilibrium opening amount which provides an air/fuel ratio for the air-fuel mixture being supplied by the primary fuel system of approximately stoichiometric (this time delay is inevitable because of the time taken for the physical elements of the bleed air control valve to move to their new positions, as well as other factors), the air/fuel ratio of the air-fuel mixture being supplied by the primary fuel supply system is the same as it was while the secondary fuel supply system was operating, i.e. is substantially larger or leaner than stoichiometric; and during this time delay interval therefore a substantially leaner air-fuel mixture than stoichiometric is supplied to the internal combustion engine. In this over lean engine operation condition the very undesirable consequences are liable to occur of deterioration of engine drivability and also of increase in the emission of nitrogen oxides or NOx in the exhaust gases of the engine, due to the poor operation of the three way catalytic converter in its mode of removing nitrogen oxides from the exhaust gases by a reducing reaction in the state of the exhaust gases of containing an excess of oxygen, i.e. of being over lean.

SUMMARY OF THE INVENTION

Accordingly, it is the primary object of the present invention to provide an air/fuel ratio control system for an internal combustion engine equipped with a double barreled carburetor and a three way catalytic converter, incorporating only one air bleed control valve, which can provide sufficiently good regulation of the air/fuel ratio delivered by the carburetor, even during rapid changing of the load on the internal combustion engine.

It is a further object of the present invention to provide an air/fuel ratio control system for an internal combustion engine equipped with a double barreled carburetor and a three way catalytic converter, incorporating only one air bleed control valve, in which the air/fuel ratio of the exhaust gases of the internal combustion engine is kept fairly near stoichiometric even when the accelerator pedal of the vehicle incorporating the engine is abruptly released from a position thereof in which both the primary throttle valve and also the secondary throttle valve of the carburetor are open to a position in which only the primary throttle valve is at all open.

It is a further object of the present invention to provide an air/fuel ratio control system for an internal combustion engine equipped with a double barreled carburetor and a three way catalytic converter, incorporating only one air bleed control valve, in which the air/fuel ratio of the exhaust gases of the internal combustion engine does not become so high (i.e. lean) as to cause improper functioning of said three way catalytic converter in its mode of purifying the exhaust gases of nitrogen oxides, even during abrupt deceleration of the vehicle incorporating the engine.

It is a further object of the present invention to provide an air/fuel ratio control system for an internal combustion engine equipped with a double barreled carburetor and a three way catalytic converter, incorporating only one air bleed control valve, which operates in the above described feedback fashion to keep the air/fuel ratio of the air-fuel mixture supplied to the engine near the stoichiometric one when the internal combustion engine is operating, even during rapid changing of the load on the internal combustion engine.

It is a further object of the present invention to provide an air/fuel ratio control system for an internal combustion engine equipped with a double barreled carburetor and a three way catalytic converter, which is cheap to manufacture.

It is a further object of the present invention to provide an air/fuel ratio control system for an internal combustion engine equipped with a double barreled carburetor and a three way catalytic converter, which is simple in operation.

It is a further object of the present invention to provide an air/fuel ratio control system for an internal combustion engine equipped with a double barreled carburetor and a three way catalytic converter, which is reliable in operation.

According to the present invention, these and other objects are accomplished by, for an internal combustion engine, comprising: (a) an exhaust system through which exhaust gases are vented; and (b) a carburetor, comprising: (b1) a primary fuel supply system comprising a primary intake passage and a primary throttle valve which controls the air flow resistance of said primary intake passage; (b2) a secondary fuel supply system comprising a secondary intake passage and a secondary throttle valve which controls the air flow resistance of said secondary intake passage, so as to keep said secondary intake passage closed when said primary throttle valve is opened to less than a certain predetermined opening amount, and so as progressively to open said secondary intake passage as said primary throttle valve is opened beyond said predetermined amount, if and only if the intake air flow through said carburetor is greater than a certain predetermined amount; (b3) a primary main fuel supply nozzle opening into said primary intake passage, fuel being supplied to said primary main fuel supply nozzle so as to be sucked therefrom into said primary intake passage by the depression in said primary intake passage, when air is flowing through said primary intake passage; and (b4) a secondary main fuel supply nozzle opening into said secondary intake passage, fuel being supplied to said secondary main fuel supply nozzle so as to be sucked therefrom into said secondary intake passage by the depression in said secondary intake passage, when air is flowing through said secondary intake passage; an air/fuel ratio control system, comprising: (c) a sensor, mounted to said exhaust system, which detects the concentration of a component in the exhaust gases in said exhaust system, and which produces a sensor electrical signal representative thereof; (d) an electrical control unit, which receives said sensor electrical signal from said sensor, and which produces a valve control electrical signal based thereon; (e) an air bleed control valve which receives said valve control electrical signal from said electrical control unit, comprising: (e1) an air inlet open to air at substantially atmospheric pressure, and (e2) an air outlet; (e3) said air bleed control valve varying its resistance to flow of air from said air inlet to said air outlet, according to said valve control electrical signal; (f) a primary air bleed path system, leading from said air outlet of said air bleed control valve, which supplies primary bleed air into the fuel which is being supplied through said primary main fuel supply nozzle into said primary intake passage; (g) a secondary air bleed path system, leading from said air outlet of said air bleed control valve, which supplies secondary bleed air into the fuel which is being supplied through said secondary main fuel supply nozzle into said secondary intake passage; and (h) a one way air valve, comprising an inlet and an outlet, fitted in said secondary air bleed path system so as to allow air flow in said secondary air bleed path only in the direction from said air outlet of said air bleed control valve towards said secondary main fuel supply nozzle.

Let us assume that said primary air bleed path system has an air flow resistance $R_1$, said secondary air bleed path system has an air flow resistance $R_2$, and said bleed control valve provides an air flow resistance $Rch_1$ when the carburetor is operating at a high load with both said primary and said secondary throttle valves being substantially opened. In this case, the amount of bleed air supplied through said first and second air bleed path systems is inversely proportional to $Rch_1+R_1R_2/(R_1+R_2)$, provided that the intake manifold vacuum remains at a constant value.

On the other hand, if the same amount of bleed air to be supplied only through a single air bleed path system provided in a conventional two barrel type carburetor, assuming that said single air bleed path system has an air flow resistance $R_0$ and that the bleed control valve which controls said single air bleed path system provides an air flow resistance $Rch_2$ at that time, then:

$$Rch_2+R_0=Rch_1+R_1R_2/(R_1+R_2) \quad (*)$$

Now, if the engine load is abruptly decreased from the above operating condition to a lower load condition in which said primary throttle valve is set at an opening amount less than said predetermined opening amount and therefore said secondary throttle valve is set at its completely closed position, said air bleed control valve in the carburetor, according to the present invention, and that of the abovementioned conventional carburetor, still provide for a certain delay time the air flow resistances of $Rch_1$ and $Rch_2$, respectively. During this delay time, the amount of bleed air supplied now only through said primary air bleed path system, according to the present invention, will be inversely proportional to $Rch_1+R_1$, whereas the amount of bleed air supplied through said single air bleed path system in the conventional carburetor will be inversely proportional to $Rch_2+R_0$. If the values of $R_1$ and $R_2$ are designed to be comparable to each other, so as for example to be equal, then in view of equation (*) above, and in view of the fact that in this case $R_1$ is twice as large as $R_1R_2/(R_1+R_2)$, the amount of bleed air supplied through said primary air bleed path system will be much smaller than that supplied through said single air bleed path system in the conventional carburetor, thereby avoiding to a certain extent the problem due to over lean air-fuel mixture supplied to the engine in such a transient period. In fact, if the air bleed system is so designed that the air flow resistance of said air bleed control valve is comparable with that of said primary and secondary air bleed path systems, so as for example to be equal, the ratio between the amount of bleed air supplied to the engine in said transient period by the carburetor, according to the present invention, and that supplied by the conventional carburetor becomes as much as 1.5 versus 2.

Further, according to another aspect of the present invention, these and other objects are more particularly and concretely accomplished by an air/fuel ratio control system of the sort described above, said sensor being an oxygen sensor which detects the concentration of oxygen in the exhaust gases within said exhaust system, and said electrical control unit producing such a valve control electrical signal, in response to said sensor electrical signal, as by supply of said bleed air to keep the air/fuel ratio of the air-fuel mixture supplied to said internal combustion engine by said carburetor substantially in a small range about the stoichiometric ratio.

Further, according to a first particular aspect of the present invention, these and other objects are more particularly and concretely accomplished by an air/fuel ratio control system of the sort described above, said carburetor further comprising a primary well within which fuel is maintained at a first predetermined fuel level, a secondary well within which fuel is maintained at a second predetermined fuel level, a primary air bleed tube protruding into said primary well below said first predetermined fuel level and formed with a plurality of air bleed holes below said first predetermined fuel level, and a secondary air bleed tube protruding into said secondary well below said second predetermined fuel level and formed with a plurality of air bleed holes below said second predetermined fuel level, a flow of basic primary bleed air being admitted into said primary air bleed tube, and a flow of basic secondary bleed air being admitted into said secondary air bleed tube, fuel-air mixture formed within said primary well being supplied to said primary main fuel supply nozzle so as to be sucked therefrom into said primary intake passage by the depression in said primary intake passage when air is flowing through said primary intake passage, and fuel-air mixture formed within said secondary well being supplied to said secondary main fuel nozzle so as to be sucked therefrom into said secondary intake passage by the depression in said secondary intake passage when air is flowing through said secondary intake passage; said primary air bleed path system supplying bleed air into fuel-air mixture formed within said primary well downstream of said primary well and upstream of said primary main fuel supply nozzle, and said secondary air bleed path system supplying bleed air into fuel-air mixture formed within said secondary well downstream of said secondary well and upstream of said secondary main fuel supply nozzle.

According to such a structure, the primary bleed air admitted via said primary air bleed path system is admitted to mix the the air-fuel mixture which has been formed by mixing the fuel within said primary well with the basic primary bleed air which has passed through said air bleed holes in said primary bleed air tube, before said air-fuel mixture passes out of said primary main fuel nozzle; and, when provided, the secondary bleed air admitted via said secondary air bleed path system is admitted to mix with the air-fuel mixture which has been formed by mixing the fuel within said secondary well with the basic secondary bleed air which has passed through said air bleed holes in said secondary bleed air tube, before said air-fuel mixture passes out of said secondary main fuel nozzle.

Further, according to another alternative particular aspect of the present invention, these and other objects are alternatively more particularly and concretely accomplished by an air/fuel ratio control system of the sort described above, said carburetor further comprising a primary well within which fuel is maintained at a first predetermined fuel level, a secondary well within which fuel is maintained at a second predetermined fuel level, a primary air bleed tube protruding into said primary well below said first predetermined fuel level and formed with a plurality of air bleed holes below said first predetermined fuel level, and a secondary air bleed tube protruding into said secondary well below said second predetermined fuel level and formed with a plurality of air bleed holes below said second predetermined fuel level, a flow of basic primary bleed air being admitted into said primary air bleed tube, and a flow of basic secondary bleed air being admitted into said secondary air bleed tube, fuel-air mixture formed within said primary well being supplied to said primary main fuel supply nozzle so as to be sucked therefrom into said primary intake passage by the depression in said primary intake passage when air is flowing through said primary intake passage, and fuel-air mixture formed within said secondary well being supplied to said secondary main fuel supply nozzle so as to be sucked therefrom into said secondary intake passage by the depression in said secondary intake passage when air is flowing through said secondary intake passage; said primary air bleed path system supplying bleed air into said primary air bleed tube to be added to said basic primary bleed air therein, and said secondary air bleed path system supplying bleed air into said secondary air bleed tube to be added to said basic secondary bleed air therein.

According to such a structure, the primary bleed air admitted via said primary air bleed path system is admitted to mix with said flow of basic primary bleed air, before said combined bleed air passes through said air bleed holes in said primary bleed air tube and mixes with the fuel within said primary well to form air-fuel mixture which passes out of said primary main fuel nozzle; and, when provided, the secondary bleed air admitted via said secondary air bleed path system is admitted to mix with said flow of basic secondary bleed air, before said combined bleed air passes through said air bleed holes in said secondary bleed air tube and mixes with the fuel within said secondary well to form air-fuel mixture which passes out of said secondary main fuel nozzle.

BRIEF DESCRIPTION OF THE DRAWINGS

The present invention will now be shown and described with reference to several preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENTS

The present invention will now be described with respect to two preferred embodiments thereof, and with respect to the accompanying drawings.

Figure 1:
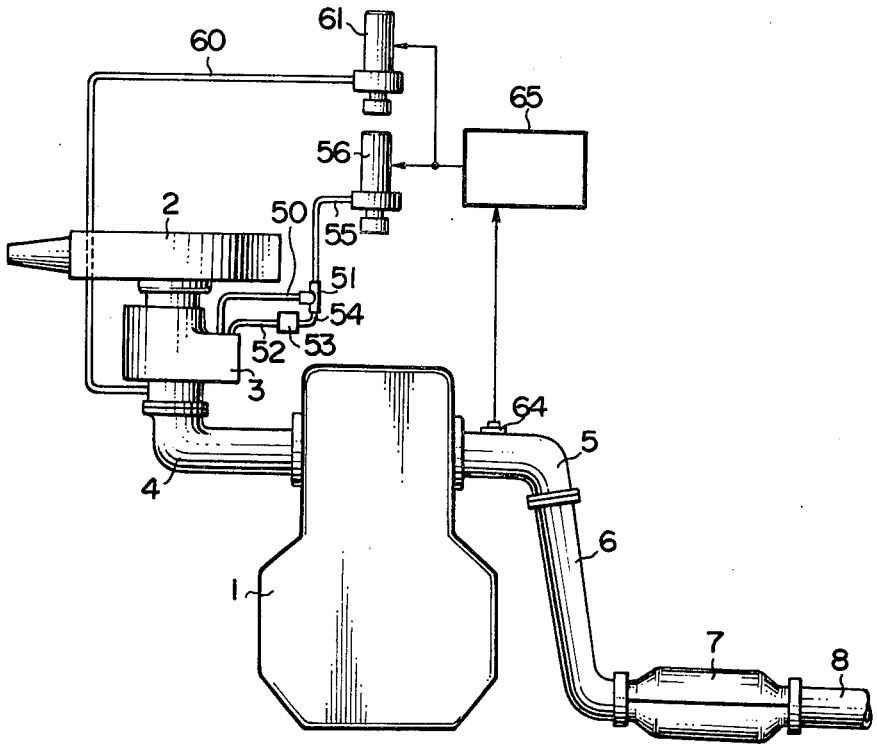
FIG. 1 is a partly schematic side view, showing an internal combustion engine incorporating an exhaust system including a three way catalytic converter and a double barreled carburetor, which is equipped with an air/fuel ratio control system according to the present invention, this figure being applicable to both the first and the second preferred embodiments of the present invention.

FIG. 1 is a partly schematic side view, which is applicable to both of the two preferred embodiments of the air/fuel ratio control system according to the present invention which will be described. An internal combustion engine 1 sucks in air through an air cleaner 2, and liquid fuel such as gasoline is mixed with this air in a carburetor 3, the air-fuel mixture thus produced being conducted through an intake manifold 4 and being sucked into and combusted in the combustion chambers of said internal combustion engine 1. These combustion chambers are not shown in the figures. The exhaust gases produced by combustion of this air-fuel mixture are vented from the internal combustion engine 1 into an exhaust manifold 5, and via an exhaust pipe 6 are conveyed to a three way catalytic converter 7, within which they are catalytically purified of various harmful exhaust components contained therein, such as HC, CO, and NOx, in a per se well known manner. From the three way catalytic converter 7 these purified exhaust gases are then vented through an exhaust pipe 8 to the atmosphere.

An oxygen sensor or O2 sensor 64 is mounted to the side of the exhaust pipe 5 so as to sense the concentration of oxygen in the exhaust gases which are being vented through the exhaust pipe 5, and an electrical sensor output signal produced by the oxygen sensor 64 and representative of said concentration is fed to an electrical control unit 65, which, based on said electrical sensor output signal, outputs a valve control electrical signal which is fed to two air bleed control valves 56 and 61 which will be more particularly described hereinafter. Via these air bleed control valves 56 and 61, via air bleed conduits 55 and 60, via a T junction 51, and via air bleed conduits 50, 52, and 53, bleed air is supplied from the atmosphere to various points within the carburetor 3, as will also be more particularly described hereinafter.

The general operation of this air/fuel ratio control system, including the operation of the electrical control unit 65, is as follows.

If the oxygen sensor 64 is detecting a surplus of oxygen in the exhaust gases which are being exhausted from the internal combustion engine 1 through the exhaust manifold 5, which indicates that the air/fuel ratio of the air-fuel mixture which is being produced by the carburetor 3 is substantially higher than the stoichiometric value, i.e. that this air-fuel mixture is over lean, then, based on the signal which the electrical control unit 65 receives from said O2 sensor 64, said electrical control unit 65 produces a valve control electrical signal which has the effect of increasing the flow resistance of the air bleed control valves 56 and 61, and thereby the amount of bleed air fed into the air-fuel mixture which is being produced by the carburetor 3 is diminished, thus decreasing the air/fuel ratio of the air-fuel mixture being produced by said carburetor 3, i.e. richening said air-fuel mixture.

On the other hand, if the oxygen sensor 64 is detecting no oxygen in the exhaust gases which are being exhausted from the internal combustion engine 1 through the exhaust manifold 5, which indicates that the air/fuel ratio of the air-fuel mixture which is being produced by the carburetor 3 is substantially lower than the stoichiometric value, i.e. that this air-fuel mixture is over rich, then, based on the signal which the electrical control unit 65 receives from said O2 sensor 64, said electrical control unit 65 produces a valve control electrical signal which has the effect of decreasing the air flow resistance of the air bleed valves 56 and 61, and thereby the amount of bleed air fed into the air-fuel mixture which is being produced by the carburetor 3 is increased, thus increasing the air/fuel ratio of the air-fuel mixture being produced by said carburetor 3, i.e. weakening said air-fuel mixture.

Various considerations arise with regard to the response time of this feedback control system, and the stability of its operation; but they are per se well known in the art, and not strictly relevant to the principles of the present invention, and will therefore not be further herein discussed. The present invention is applicable to any system of the general sort outlined herein above.

In relation to the operation of this feedback control system for bleed air amount, it will be understood by one skilled in the art that variation of the air flow within the carburetor 3, and/or variation of the amount of fuel which is being mixed into this air flowing through the carburetor 3 to produce air-fuel mixture, may be coped with in a feedback fashion by the air/fuel ratio control system comprising this electrical control unit 65, etc., provided that such variations are reasonably slow. On the other hand, if the variation in the air flow in the carburetor 3, or the variation in the amount of fuel being mixed in therewith by the carburetor 3, is rather quick, then, because of the time taken for air-fuel mixture to pass through the internal combustion engine 1 and for the exhaust gases resulting from the combustion of this air-fuel mixture to be exhausted into the exhaust pipe 5 so as to affect the oxygen sensor 64, and because also of the finite response time of the electrical control unit 65 and of the air bleed control valves 61 and 56, etc., then for a certain transient time the air/fuel ratio of the air-fuel mixture being conducted through the inlet manifold 4 into the combustion chambers of the internal combustion engine 1 will deviate from the stoichiometric value. If this deviation is too great and is maintained for too long a time, this will cause improper operation of the three way catalytic converter 7, and therefore undesirable pollutants such as HC, CO, or nitrogen oxides (depending upon whether the deviation from the stoichiometric condition of the exhaust gases has been in the direction of over rich or over lean air-fuel mixture) will be emitted in the exhaust gases expelled through the exhaust pipe 8 to the atmosphere, which is very undesirable, especially in view of the fact that the standards for quality control of such exhaust gases are becoming more and more severe nowadays. Accordingly, it is desirable that the rate of variation of the air flow through the carburetor 3, and the rate of variation of the amount of fuel being mixed into this air to form air-fuel mixture, should be minimized or kept reasonably low, or at least that this variation should not actually be discontinuous.

Figure 2:
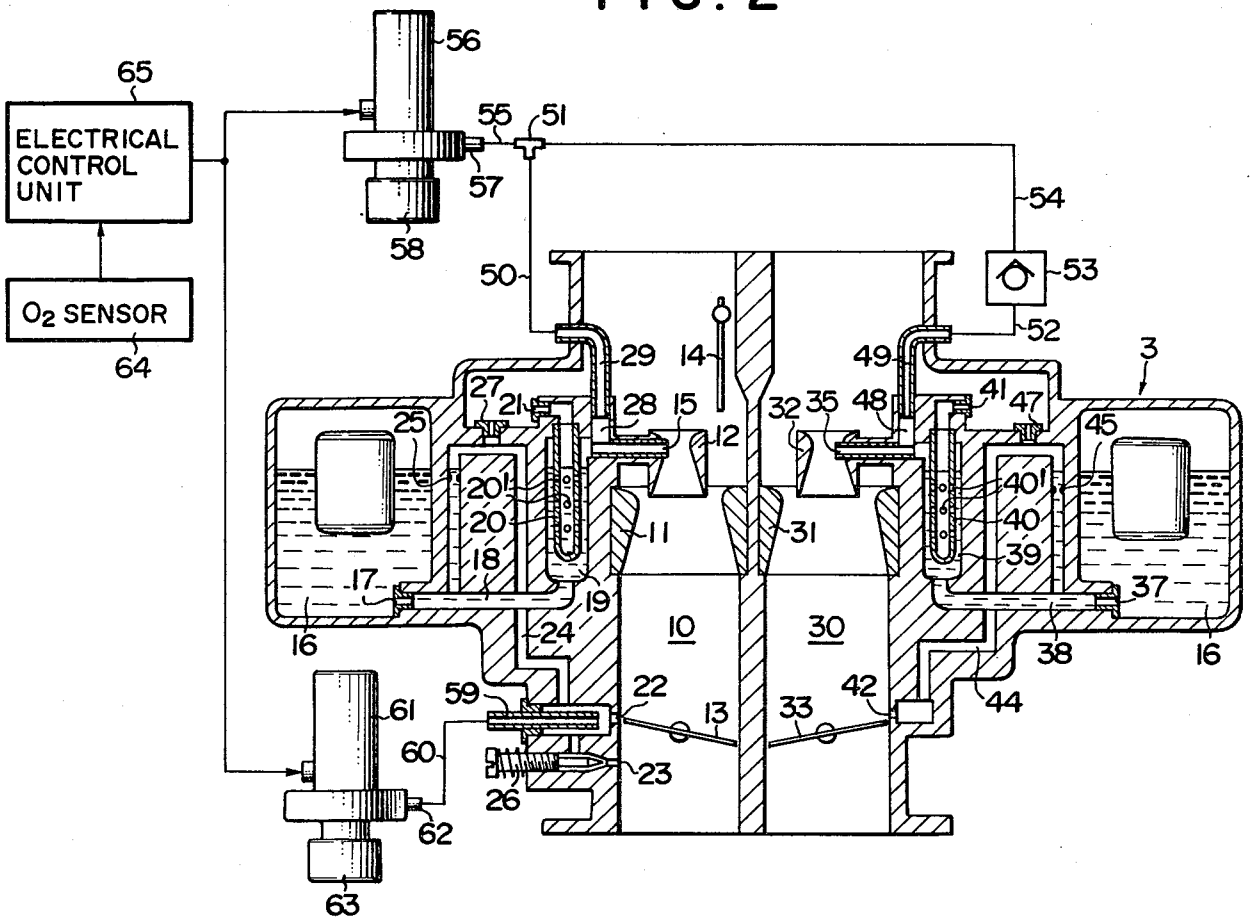
FIG. 2 is a part sectional view of the above mentioned double barreled carburetor to which the first preferred embodiment of the air/fuel ratio control system according to the present invention is applied, and also shows in schematic view the constituent parts of said first preferred embodiment of the present invention.

In FIG. 2, there is presented a sectional view of the carburetor 3, and also a schematic view of other parts of the first preferred embodiment of the air/fuel ratio control system according to the present invention. In FIG. 2, reference numerals which denote parts which correspond to parts shown in FIG. 1 are the same as the numerals used in FIG. 1.

The carburetor 3 is a double barreled carburetor, and in fact in this case is a down draft double barreled carburetor. In the carburetor 3 there are formed a primary intake passage 10 and a secondary intake passage 30.

In the primary intake passage 10 there is provided a primary large venturi 11, and in the secondary intake passage 30 there is provided a secondary large venturi 31. In the throat of the primary large venturi 11 there is provided a primary small venturi 12, and, similarly, in the throat of the secondary large venturi 31 there is provided a secondary small venturi 32. Downstream from the primary large venturi 11 in the primary intake passage 10 there is mounted a butterfly type primary throttle valve 13, and, similarly, downstream from the secondary large venturi 31 in the secondary intake passage 30 there is mounted a butterfly type secondary throttle valve 33. Further, upstream of the primary small venturi 12 in the primary intake passage 10 there is mounted a choke valve 14, which will not be further discussed herein, because it is not relevant to the present invention.

In a per se well known fashion, as the accelerator pedal (which is not shown) of the vehicle in which this system is incorporated is progressively depressed, the primary throttle valve 13 is progressively opened; and, again in a per se well known fashion, when the primary throttle valve 13 has opened to a certain predetermined amount, then the secondary throttle valve 33 commences to be opened, and, as the primary throttle valve 13 progressively opens beyond this predetermined amount, progressively the secondary throttle valve 33 is opened along therewith, provided that the rate of intake air flow is also greater than a certain predetermined amount.

Into the throat portion of the primary small venturi 12 there opens a primary main fuel supply nozzle 15, and, similarly, into the throat portion of the secondary small venturi 32 there opens a secondary main fuel supply nozzle 35. A common float chamber 16, which serves both the primary fuel supply system and also the secondary fuel supply system, is kept filled to a certain predetermined level with liquid fuel, which in the present case is gasoline, by a float and needle valve system of a conventional kind not fully shown in the drawings and not further discussed here. A primary main fuel supply passage 18 leads from a lower part of the float chamber 16 to a primary well 19, the flow rate of gasoline from the float chamber 16 into the end joining thereto of this primary main fuel supply passage 18 being regulated by a primary main fuel jet 17 fitted into said end of said primary fuel supply passage 18. Similarly, a secondary main fuel supply passage 38 leads from another lower part of the float chamber 16 to a secondary well 39, the flow rate of gasoline from the float chamber 16 into the end joining thereto of this secondary main fuel supply passage 38 being regulated by a secondary main fuel jet 37 fitted into said end of said secondary main fuel supply passage 38. The upper part of the primary well 19 is communicated to the primary main fuel supply nozzle 15, and, similarly, the upper part of the secondary well 39 is communicated to the secondary main fuel supply nozzle 35.

A primary air bleed tube 20 formed with a plurality of small primary air bleed holes 20′ extends downwards into the primary well 19, and the upper end of this primary air bleed tube 20 is communicated, via a fixed metering primary air bleed jet 21, to the atmosphere. As can be seen in FIG. 2, these small primary air bleed holes 20′ are arranged to be below the level of the surface of the liquid fuel within the primary well 19, when this fuel is in a state of static equilibrium with the fuel in the float chamber 16.

Similarly, a secondary air bleed tube 40 formed with a plurality of small secondary air bleed holes 40′ extends downwards into the secondary well 39, and the upper end of this secondary air bleed tube 40 is communicated, via a fixed metering secondary air bleed jet 41, to the atmosphere. Similarly to the primary air bleed holes 20′ in the primary fuel system, these small secondary air bleed holes 40′ are arranged to be below the level of the surface of the liquid fuel within the secondary well 39, when this fuel is in a state of static equilibrium with the fuel in the float chamber 16.

Thus, during operation of the internal combustion engine 1, when air is flowing through the primary intake passage 10, depression in the primary small venturi 12 in this primary intake passage 10 in the vicinity of the primary main fuel supply nozzle 15 sucks liquid fuel out from the float chamber 16, through the primary main fuel jet 17 which meters its flow, along the primary main fuel supply passage 18, and into the primary well 19. Atmospheric air is also sucked in through the primary fixed air bleed jet 21 (which meters its flow) into the primary air bleed tube 20 and out through the plurality of primary air bleed holes 20′ therein to be mixed with this liquid fuel present within the primary well 19, and this mixture of liquid gasoline together with bleed air is sucked along towards and out of the primary main fuel supply nozzle 15, so as to be ejected within the primary small venturi 12 and therein sprayed into and mixed with the air which is flowing through the primary intake passage 10. In an exactly similar fashion, when air is flowing through the secondary intake passage 30, depression in the secondary small venturi 32 in this secondary intake passage 30 in the vicinity of the secondary main fuel supply nozzle 35 sucks liquid fuel out of the float chamber 16, through the secondary main fuel jet 37 which meters its flow, along the secondary main fuel supply passage 38, and into the secondary well 39. Atmospheric air is also sucked in through the secondary fixed air bleed jet 41 (which meters its flow) into the secondary air bleed tube 40 and out through the plurality of secondary air bleed holes 40′ therein to be mixed with this liquid fuel present within the secondary well 39, and this mixture of liquid gasoline together with bleed air is sucked along towards and out of the secondary main fuel supply nozzle 35, so as to be ejected within the secondary small venturi 32 and therein sprayed into and mixed with the air which is flowing through the secondary intake passage 30.

This system ensures that the amount of fuel ejected from the primary and secondary main fuel supply nozzles 15 and 35 is reduced, according to the amount of bleed air supplied thereinto, so that the air/fuel ratio of the air-fuel mixture passing into the inlet manifold 4 from the primary and secondary intake passages 10 and 30 is increased, i.e. this air-fuel mixture is made leaner. In fact, the air/fuel ratio of the air-fuel mixture thus produced is set to be still a somewhat richer air/fuel ratio than the stoichiometric value, so that the basic air-fuel mixture produced by the carburetor 3 in the fashion described above is still somewhat rich.

Within the primary intake passage 10 there is provided a primary slow fuel port 22, which opens to a point on the inner surface of the primary intake passage 10 which is upstream of the primary throttle valve 13 when the primary throttle valve 13 is in the substantially closed position as shown in FIG. 2, but which is downstream of the primary throttle valve 13 when the primary throttle valve 13 is opened by more than a very small amount. Similarly, within the secondary intake passage 30 there is provided a secondary slow fuel port 42, which opens to a point on the inner surface of the secondary intake passage 30 which is upstream of the secondary throttle valve 33 when the secondary throttle valve 33 is in the substantially closed position as shown in FIG. 2, but which is downstream of the secondary throttle valve 33 when the secondary throttle valve 33 is opened by more than a very small amount. Further, a primary idle port 23 is provided within the primary intake passage 10, and opens at a point on the surface thereof which is always downstream of the primary throttle valve 13. No idle port is provided within the secondary intake passage 30, for reasons which will be obvious to one skilled in the art.

A primary slow fuel passage 24 branches off from an intermediate point of the primary main fuel supply passage 18, and this primary slow fuel passage 24 supplies fuel to the primary slow fuel port 22 and also to the primary idle port 23. Similarly, a secondary slow fuel passage 44 branches off from an intermediate point of the secondary main fuel supply passage 38, and this secondary slow fuel passage 44 supplies fuel to the secondary slow fuel port 42. A fixed amount of bleed air is admitted to an intermediate part of the primary slow fuel passage 24 through a fixed primary slow air bleed jet 27, and, similarly, a fixed amount of bleed air is admitted to an intermediate part of the secondary slow fuel passage 44 through a fixed secondary slow air bleed jet 47. Further, the rate of ejection of fuel and bleed air mixture through the primary idle port 23 may be regulated by a manually settable idle adjuster screw 26 in a per se well known fashion.

These arrangements regarding the primary and secondary slow fuel passages 24 and 44, the primary and secondary slow ports 22 and 42, and the primary idle port 23, are not directly relevant to the gist of the present invention, and are only described here for the purposes of completeness of explanation.

There will now be described the arrangements for providing a variable amount of extra bleed air into the mixture, composed of fuel and the above described basic bleed air, which is being ejected from the primary main fuel supply nozzle 15 and from the secondary main fuel supply nozzle 35.

To the base end of the primary main fuel supply nozzle 15, close to where said nozzle 15 opens into the primary well 19, there opens the lower end of a primary extra air bleed passage 28. The other end of this primary extra air bleed passage 28 is connected to the lower end of an air bleed conduit 29, which projects upwards as seen in FIG. 2 out of the body of the carburetor 3. According to the present invention, similarly, to the base end of the secondary main fuel supply nozzle 35, close to where said nozzle 35 opens into the secondary well 39, there opens the lower end of a secondary extra air bleed passage 48. The other end of this secondary extra air bleed passage 48 is connected to the lower end of an air bleed conduit 49, which projects upwards as seen in FIG. 2 out of the body of the carburetor 3.

The end remote from the carburetor 3 of the primary air bleed conduit 29 is connected to one end of an air bleed conduit 50, already mentioned, and the end remote from the carburetor 3 of the air bleed conduit 49 is connected to one end of another air bleed conduit 52. The other end of the air bleed conduit 52 is connected to the outlet of a one way air valve 53. The inlet of the one way air valve 53 is connected to one end of an air bleed conduit 54. The other end of the air bleed conduit 50 and the other end of the air bleed conduit 54 are connected to the two outlets of a T junction or pipe branch 51, and the inlet of this T junction 51 is connected to one end of an air bleed conduit 55, the other end of which is connected to the outlet 57 of the above mentioned air bleed control valve 56.

The direction of flow available through the one way air valve 53, as intimated above, is such that bleed air can flow from the air bleed conduit 54 through the one way air valve 53 into the air bleed conduit 52, but cannot flow in the reverse direction from the air bleed conduit 52 through the one way air valve 53 into the air bleed conduit 54. The one way air valve 53 prevents air flowing from the secondary main fuel supply nozzle 35 to the primary air bleed path system when only the primary air bleed path system is operating.

Further, arrangements are provided for admitting a certain variable amount of extra bleed air into the liquid fuel which is being emitted from the primary slow fuel port 22 and/or from the primary idle port 23, which will now be described. A bleed air conduit 59 has its outer end projected from the outside of the carburetor 3, while its inner end extends into a well formed at an intermediate portion of the primary slow fuel passage 24, the base of the primary slow fuel port 22 also opening into this well. Thus, when bleed air is supplied to this bleed air conduit 59, it is mixed in to the mixture of liquid fuel flowing within the primary slow fuel passage 24 and the fixed amount of bleed air which has been mixed in therewith by passage thereof in through the fixed primary slow air bleed jet 27, said air-fuel mixture being supplied both to the primary slow fuel port 22 and to the primary idle port 23.

To the outside end of the air bleed conduit 59, i.e., to its end remote from the carburetor 3, there is connected one end of the above mentioned air bleed conduit 60, and the other end of this air bleed conduit 60 is connected to the outlet 62 of the above mentioned air bleed control valve 61.

The air flow passage provided by the air bleed conduit 50, the air bleed conduit 29, and the air bleed passage 28 connected in series forms a primary air bleed path system which has a certain first air flow resistance, while the air flow passage provided by the air bleed conduit 54, the one way air valve 53, the air bleed conduit 52, the air bleed conduit 49, and the air bleed passage 48 connected in series forms a secondary air bleed path system which has a certain second air flow resistance.

The air bleed control valve 56 and the air bleed control valve 61 are both of the same sort, which is a sort conventionally well known and used in the art. Each of these air bleed control valves 56 and 61 has an air inlet, these air inlets being denoted respectively by the reference numerals 58 and 63, which is open to the atmosphere, and an air outlet, denoted respectively by 57 and 62, at which a regulated amount of bleed air is provided. Each of these air bleed control valves 56 and 61, according to the value of an electrical signal which is supplied to an input terminal thereof, varies the resistance to air flow between its inlet 58 or 63 and its outlet 55 or 62 in a progressive fashion; that is, according to the value of the above mentioned valve control electrical signal, the air flow resistance of each of these bleed air control valves 56 and 61 can be varied relatively smoothly from an essentially infinite value, when no air bleed is provided by the valve and its inlet is shut off from its outlet, down to a certain basic or fully open value, through a range of values of air flow resistance. Such bleed air control valves are well known in the art, and, for example, include electric air control valves which comprise a valve element which responds to an electrical impulse provided to the input terminal of the value, and which may be of the linear motor type, the linear solenoid type, or the step motor type.

As has been outlined above, an oxygen sensor or O2 sensor 64 is fitted to the exhaust manifold 5. An output signal is produced by this oxygen sensor 64, and is representative of the concentration of oxygen in the exhaust gases in the exhaust pipe 5. The electrical control unit 65 receives this electrical sensor output signal, and, based thereupon, outputs the valve control electrical signal, which, in the shown first preferred embodiment of the present invention, is fed to both of the air bleed control valves 56 and 61, so as to cause them to regulate their air flow resistance and so as thereby to regulate the amount of bleed air which is admitted, respectively, into the air bleed conduits 55 and 60. In more detail, the electrical control unit 65 is so constituted that when it receives an electrical sensor output signal from the oxygen sensor 64 indicative of the presence of substantially no oxygen in the exhaust gases in the exhaust pipe 5, then said electrical control unit 85 generates such a valve control electrical signal as, when fed to the air bleed control valves 56 and 61, causes their opening amounts to increase, i.e. causes their flow resistances to decrease; and, conversely, when the electrical control unit 65 receives an electrical sensor output signal from the oxygen sensor 64 indicative of the presence of a substantial amount of oxygen in the exhaust gases in the exhaust pipe 5, then said electrical control unit 65 generates such a valve control electrical signal as, when fed to the air bleed control valves 56 and 61, causes their opening amounts to decrease i.e. causes their flow resistances to increase.

Thus, suppose that the internal combustion engine is operating steadily at a certain load level, with the primary throttle valve 13 open by a certain amount and possibly the secondary throttle valve 33 open by a certain amount. Now, in this state which for the moment should be assumed to be fairly steady, when the oxygen sensor 64 is not detecting the presence of substantially any oxygen in the exhaust gases of the internal combustion engine 1 in the exhaust pipe 5, which indicates that the air/fuel ratio of the air-fuel mixture being supplied to the engine by the carburetor 3 is substantially richer, i.e., smaller, than stoichiometric, then the electrical control unit 65, which is receiving an electrical sensor output signal representative of this state of affairs from the oxygen sensor 64, is outputting a valve control electrical signal to the air bleed control valves 56 and 61 which is causing their opening amounts to increase. By the increasing opening of the air bleed control valve 61, an increasing amount of bleed air is supplied into the fuel which is being ejected from the primary slow port 22 and/or from the primary idle port 23, if any such fuel is in fact being ejected; and by the increasing opening of the air bleed control valve 56 an increasing amount of bleed air is supplied into the fuel which is being ejected from the primary main fuel nozzle 15 due to the depression in the primary inlet passage 10 in the vicinity of the primary small venturi 12, and, in the case that the secondary throttle valve 33 is opened and significant depression exists in the secondary inlet passage 30 in the vicinity of the primary small venturi 32, an increasing amount of bleed air is supplied into the fuel which is being ejected from the primary main fuel nozzle 15 due to this depression in the primary inlet passage 10 in the vicinity of the primary small venturi 12. (On the other hand, if no significant depression exists in the secondary inlet passage 30 in the vicinity of the primary small venturi 32, the provision of the one way valve 53 prevents reverse flow of air at atmospheric pressure from the secondary main fuel nozzle 35, through the conduit 52, the one way valve 53, the conduit 54, and into the conduit 50 to be mixed in with the bleed air from the air bleed control valve 56 which is being supplied via the conduit 50 to the primary main fuel nozzle 15). Thus, the air/fuel ratio of the air-fuel mixture being supplied to the engine by the carburetor 3 is steadily increased, so as to bring it closer to stoichiometric.

On the other hand, if in this state which for the moment is assumed to be fairly steady the oxygen sensor 64 is detecting the presence of a substantial amount of oxygen in the exhaust gases of the internal combustion engine 1 in the exhaust pipe 5, which indicates that the air/fuel ratio of the air-fuel mixture being supplied to the engine by the carburetor 3 is substantially leaner, i.e. larger, than stoichiometric, then the electrical control unit 65, which is receiving an electrical sensor output signal representative of this state of affairs from the oxygen sensor 64, is outputting a valve control electrical signal to the air bleed control valves 56 and 61 which is causing their opening amounts to decrease. By the decreasing opening of the air bleed control valve 61, a decreasing amount of bleed air is supplied into the fuel which is being ejected from the primary slow port 22 and/or from the primary idle port 23, if any such fuel is in fact being ejected; and by the decreasing opening of the air bleed control valve 56 a decreasing amount of bleed air is supplied into the fuel which is being ejected from the primary main fuel nozzle 15 due to the depression in the primary inlet passage 10 in the vicinity of the primary small venturi 12, and, in the case that the secondary throttle valve 33 is opened and significant depression exists in the secondary inlet passage 30 in the vicinity of the primary small venturi 32, a decreasing amount of bleed air is supplied into the fuel which is being ejected from the primary main fuel nozzle 15 due to this depression in the primary inlet passage 10 in the vicinity of the primary small venturi 12. (Again, on the other hand, if no significant depression exists in the secondary input passage 30 in the vicinity of the primary small venturi 32, the provision of the one way valve 53 prevents reverse flow of air at atmospheric pressure from the secondary main fuel nozzle 35, through the conduit 52, the one way valve 53, the conduit 54, and into the conduit 50 to be mixed in with the bleed air from the air bleed control valve 56 which is being supplied via the conduit 50 to the primary main fuel nozzle 15). Thus, the air/fuel ratio of the air-fuel mixture being supplied to the engine by the carburetor 3 is steadily decreased, so as to bring it closer to stoichiometric.

Thus, by a feedback process of the sort outlined above, the air/fuel ratio of the air-fuel mixture being supplied to the engine by the carburetor 3 is kept more or less at the stoichiometric value, i.e. is kept within a fairly narrow range about the stoichiometric value, during steady state operation of the internal combustion engine 1 at a definite load value, i.e. a definite throttle opening. In this case, as so far described, the effect of the operation of the air/fuel ratio control system according to this first preferred embodiment of the present invention is substantially the same as the effect of a conventional or prior art system; although in the present system the bleed air regulated by the bleed air control valve 56 is in fact injected into the carburetor both through the primary main fuel nozzle 12 and also through the secondary main fuel nozzle 32 (in the case that the secondary throttle valve 33 is significantly open) as bleed air, this produces no particular novel effects in the steady state operational condition.

Suppose now however that the load on the internal combustion engine 1, i.e. the throttle opening thereof, varies. The operation of the air/fuel ratio control system according to this first preferred embodiment of the present invention, and its superiority over the prior art conventional systems, will now be described with reference to the case that: first the internal combustion engine 1 is operating at high load, with both the primary throttle valve 13 and also the secondary throttle valve 33 opened; and then the load is quickly or abruptly diminished, so that the secondary throttle valve 33 is suddenly completely closed.

When the internal combustion engine 1 is operating at high load, with both the primary throttle valve 13 and also the secondary throttle valve 33 opened, bleed air will be supplied through the bleed air control valve 56, the conduit 55, the T junction 51, and the conduit 50 to the primary air bleed conduit 29 to be supplied into the primary extra air bleed passage 28 to mix with the air-fuel mixture being ejected from the primary main fuel nozzle 15 on the one hand, while on the other hand bleed air will pass through the conduit 54 and the one way air valve 53 and the conduit 52 to the secondary air bleed conduit 49 to be supplied into the secondary extra air bleed passage 48 to mix with the air-fuel mixture being ejected from the secondary main fuel nozzle 35. In this state, by the feedback action explained above the opening of the air bleed control valve 56 will be brought to such an opening as to provide such an amount of bleed air as to make the air/fuel ratio of the air-fuel mixture being supplied by the carburetor 3 substantially the stoichiometric value.

At this time—in contradistinction to the operation of the conventional prior art type system discussed above in the section of this specification entitled "BACKGROUND OF THE INVENTION" in which the additional bleed air supplied through the bleed air control valve is added only to the air-fuel mixture which is being discharged through the primary main fuel nozzle into the primary air intake passage and not to the air-fuel mixture which is being discharged through the secondary main fuel nozzle into the secondary air intake passage and in which prior art system therefore in such high load operational conditions as these the air/fuel ratio of the air-fuel mixture being generated in the primary air intake passage is substantially leaner than stoichiometric while the air/fuel ratio of the air-fuel mixture being generated in the secondary air intake passage is substantially richer than stoichiometric—because according to the essence of the present invention the additional bleed air supplied through the bleed air control valve is added both to the air-fuel mixture which is being discharged through the primary main fuel nozzle into the primary air intake passage and also to the air-fuel mixture which is being discharged through the secondary main fuel nozzle into the secondary air intake passage, the air/fuel ratio of the air-fuel mixture being generated in the primary air intake passage is quite close to stoichiometric while the air/fuel ratio of the air-fuel mixture being generated in the secondary air intake passage is also quite close to stoichiometric.

Suppose now that, from the operational condition the load on the internal combustion engine 1 is abruptly decreased, so that the secondary throttle valve 33 is now completely closed. At this time the flow of air through the secondary air intake passage 30 will abruptly cease, and thus the depression within the secondary air intake passage 30 in the vicinity of the secondary small venturi 35 will abruptly disappear, thus causing the ceasing of the sucking out of fuel out of the secondary main fuel nozzle 35 and also the sucking in of bleed air to be mixed in with this fuel, both main bleed air through the secondary fixed air bleed jet 41 and also additional bleed air from the bleed air control valve 56 through the conduit 55, the T junction 51, the conduit 54, the one way air valve 53 in the direction of flow allowed by it, the conduit 52, and the secondary air bleed conduit 49 and the secondary extra air bleed passage 48. In the same way as detailed above, therefore, based upon the signal from the oxygen sensor 64, the electrical control unit 65 will generate such a control signal for the bleed air control valves 56 and 61 as to control them to provide a proper amount of bleed air in this new operational condition to bring the air/fuel ratio of the air-fuel mixture generated by the carburetor 3 as a whole to substantially the stoichiometric one.

However, the closing of the bleed air control valves 56 and 61 to their new lesser opening amounts, although quite quick, is by no means instantaneous as described above. However, in the present invention, because according to the essence of the present invention the additional bleed air supplied through the bleed air control valve when both the primary throttle valve and also the secondary throttle valve were open was added both to the air-fuel mixture which was being discharged through the primary main fuel nozzle into the primary air intake passage and also to the air-fuel mixture which was being discharged through the secondary main fuel nozzle into the secondary air intake passage, and therefore as detailed above the air/fuel ratio of the air-fuel mixture being generated in the primary air intake passage was quite close to stoichiometric while the air/fuel ratio of the air-fuel mixture being generated in the secondary air intake passage was also also quite close to stoichiometric, and further the air flow resistance of the primary air bleed path system and the secondary air bleed path system can each be increased as compared with the case of the conventional single air bleed path system, for the short transient time after the quick closing of the secondary throttle valve until the bleed air control valves 56 and 61 have reached their proper new opening amounts, the deviation of the air/fuel ratio of the air-fuel mixture supplied only through the primary fuel supply system from that of the air-fuel mixture which was previously being generated in the primary and secondary air intake passages is quite small. Thus it is avoided, in the operation of the present invention, that when the secondary throttle valve 33 of the carburetor 3 is quickly completely closed the exhaust gases of the engine should deviate from the stoichiometric condition toward the lean side by a substantial amount for a certain transient time; in other words, it is avoided that for such a transient time the functioning of the three way catalytic converter 7 for purifying the exhaust gases passing therethrough of nitrogen oxides or NOx by a reducing reaction should be significantly interrupted.

Figure 3:
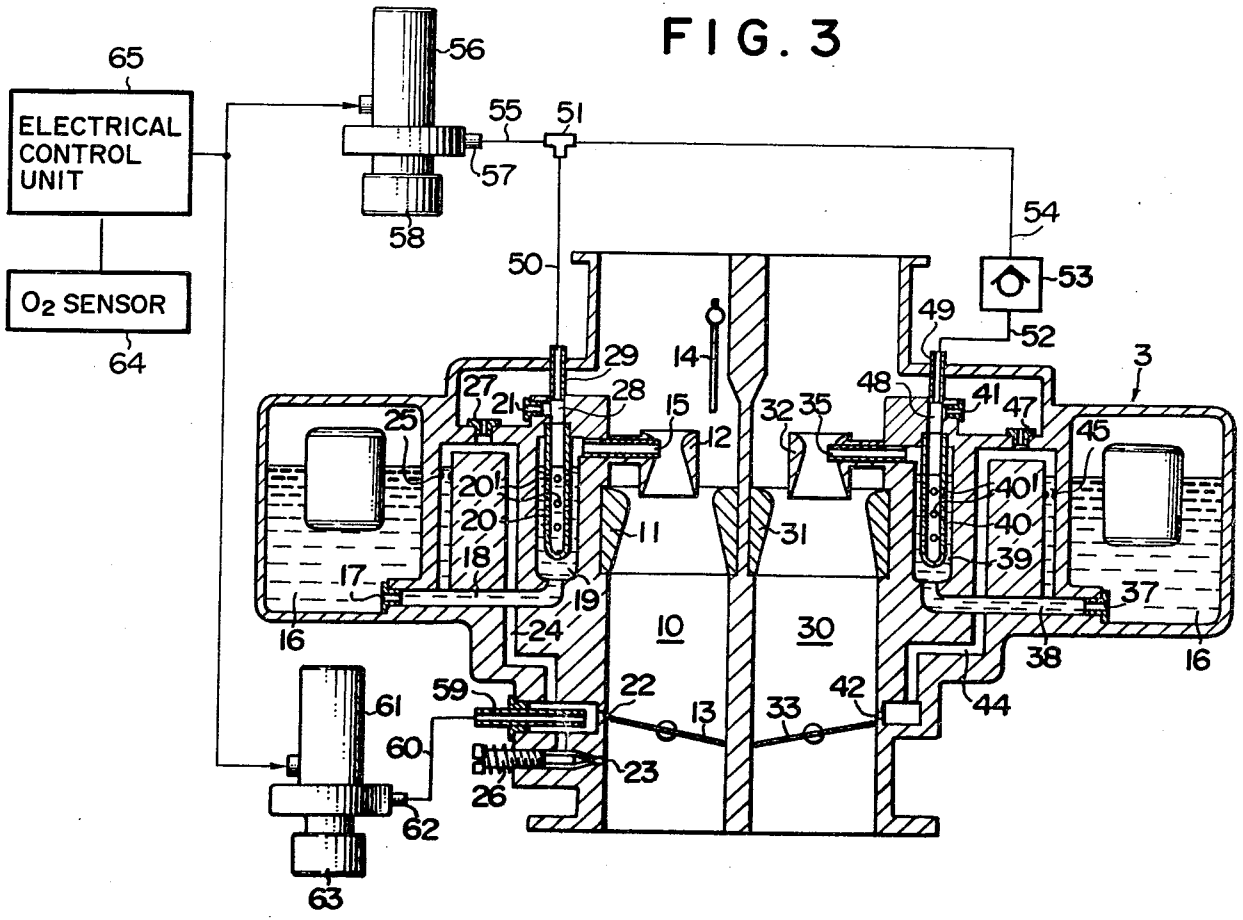
FIG. 3 is a part sectional view, similar to FIG. 2, of the double barreled carburetor to which the second preferred embodiment of the air/fuel ratio control system according to the present invention is applied, and also shows in schematic view the constituent parts of said second preferred embodiment of the present invention.

In FIG. 3, there is presented a sectional view of the carburetor 3, and also a schematic view of other parts of, a second preferred embodiment of the air/fuel ratio control system according to the present invention, in a fashion similar to FIG. 2. In FIG. 3, parts of the second preferred embodiment shown, which correspond to parts of the first preferred embodiment shown in FIG. 2, and which have the same functions, are designated by the same reference numerals and symbols as in that figure.

In this second preferred embodiment, the only differences are that the bleed air which is being supplied via the bleed air control valve 56 to the primary fuel system of the carburetor 3 via the the primary air bleed conduit 29 to be supplied into the primary extra air bleed passage 28 is not mixed directly with the air-fuel mixture which is being ejected through the primary main fuel nozzle 15, just before it is so ejected, but is instead added to the basic bleed air which has passed through the the primary fixed air bleed jet 21 (which meters its flow) into the primary air bleed tube 20, so as to pass out through the plurality of primary air bleed holes 20' therein to be mixed with the liquid fuel present within the primary well 19, so that this fuel mixed with both the basic bleed air and also the additional bleed air supplied through the bleed air control valve 56 is sucked along towards and out of the primary main fuel supply nozzle 15 to be ejected within the primary small venturi 12 and sprayed into and mixed with the air which is flowing through the primary intake passage 10, and similarly the bleed air which is being supplied via the bleed air control valve 56 to the secondary fuel system of the carburetor 3 via the the secondary air bleed conduit 49 to be supplied into the secondary extra air bleed passage 48 is not mixed directly with the air-fuel mixture which is being ejected through the secondary main fuel nozzle 35, just before it is so ejected, but is instead added to the basic bleed air which has passed through the secondary fixed air bleed jet 41 (which meters its flow) into the secondary air bleed tube 40, so as to pass out through the plurality of secondary air bleed holes 40' therein to be mixed with the liquid fuel present within the secondary well 39, so that this fuel mixed with both the basic bleed air and also the additional bleed air supplied through the bleed air control valve 56 is sucking along towards and out of the secondary main fuel supply nozzle 35 to be ejected within the secondary small venturi 32 and sprayed into and mixed with the air which is flowing through the secondary intake passage 20. It will be readily apparent to one skilled in the art, based upon the foregoing disclosure, that the operation of this second preferred embodiment of the air/fuel ratio control system according to the present invention is almost the same as that of the first preferred embodiment, mutatis mutandis, although the place of injection of the bleed air into the primary and secondary fuel systems of the carburetor 3 affects the air flow resistance of the primary and secondary air bleed path systems; what is important for the essence of the present invention is that this bleed air should be supplied both to the primary fuel system of the carburetor 3 and also to the secondary fuel system thereof, from the one bleed air control valve 56, with the interposition of the one way air valve 53 in the conduit leading to the secondary fuel system. Accordingly, further description of the operation of this second preferred embodiment of the air/fuel ratio control system according to the present invention will be foregone here, in the interests of avoiding redundancy of description.

Although the present invention has been shown and described with reference to several preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiments, or of the drawings, but solely by the scope of the appended claims, which follow.

What is claimed is:

1. An air/fuel ratio control system for an internal combustion engine having, (a) an exhaust system through which exhaust gases are vented; and (b) a carburetor having, (b1) a primary fuel supply system comprising a primary intake passage and a primary throttle valve which controls the air flow resistance of said primary intake passage;

(b2) a secondary fuel supply system comprising a secondary intake passage and a secondary throttle valve which controls the air flow resistance of said secondary intake passage, so as to keep said secondary intake passage closed when said primary throttle valve is opened to less than a certain predetermined opening amount, and so as progressively to open said secondary intake passage as said primary throttle valve is opened beyond said predetermined amount, if and only if the intake air flow through said carburetor is greater than a certain predetermined amount;

(b3) a primary main fuel supply nozzle opening into said primary intake passage, fuel being supplied to said primary main fuel supply nozzle so as to be sucked therefrom into said primary intake passage by the depression in said primary intake passage, when air is flowing through said primary intake passage; and (b4) a secondary main fuel supply nozzle opening into said secondary intake passage, fuel being supplied to said secondary main fuel supply nozzle so as to be sucked therefrom into said secondary intake passage by the depression in said secondary intake passage, when air is flowing through said secondary intake passage;

said air/fuel ratio control system, comprising:

(c) a sensor, mounted to said exhaust system, which detects the concentration of a component in the exhaust gases in said exhaust system, and which produces a sensor electrical signal representative thereof;

(d) an electrical control unit, which receives said sensor electrical signal from said sensor, and which produces a valve control electrical signal based thereon;

(e) an air bleed control valve which receives said valve control electrical signal from said electrical control unit, comprising:
  (e1) an air inlet open to air at substantially atmospheric pressure, and
  (e2) an air outlet;
  (e3) said air bleed control valve varying its resistance to flow of air from said air inlet to said air outlet, according to said valve control electrical signal;
(f) a primary air bleed path system, leading from said air outlet of said air bleed control valve, which supplies primary bleed air into the fuel which is being supplied through said primary main fuel supply nozzle into said primary intake passage;
(g) a secondary air bleed path system, leading from said air outlet of said air bleed control valve, which supplies secondary bleed air into the fuel which is being supplied through said secondary main fuel supply nozzle into said secondary intake passage; and
(h) a one-way air valve, comprising an inlet and an outlet, fitted in said secondary air bleed path system so as to allow air flow in said secondary air bleed path only in the direction from said air outlet of said air bleed control valve towards said secondary main fuel supply nozzle wherein the operational relation between said sensor, said electrical control unit, and said air bleed control valve is to control the sum of supply of said primary bleed air and said secondary bleed air so as to keep the air/fuel ratio of the air-fuel mixture supplied to said internal combustion engine by said carburetor substantially in a small range about the stoichiometric ratio.

2. An air/fuel ratio control system according to claim 1, said sensor being an oxygen sensor which detects the concentration of oxygen in the exhaust gases within said exhaust system.

3. An air/fuel ratio control system according to either one of claims 1 and 2, said carburetor further comprising a primary well within which fuel is maintained at a first predetermined fuel level, a secondary well within which fuel is maintained at a second predetermined fuel level, a primary air bleed tube protruding into said primary well below said first predetermined fuel level and formed with a plurality of air bleed holes below said first predetermined fuel level, and a secondary air bleed tube protruding into said secondary well below said second predetermined fuel level and formed with a plurality of air bleed holes below said second predetermined fuel level, a flow of basic primary bleed air being admitted into said primary air bleed tube, and a flow of basic secondary bleed air being admitted into said secondary air bleed tube, fuel-air mixture formed within said primary well being supplied to said primary main fuel supply nozzle so as to be sucked therefrom into said primary intake passage by the depression in said primary intake passage when air is flowing through said primary intake passage, and fuel-air mixture formed within said secondary well being supplied to said secondary main fuel supply nozzle so as to be sucked therefrom into said secondary intake passage by the depression in said secondary intake passage when air is flowing through said secondary intake passage; said primary air bleed path system supplying bleed air into fuel-air mixture formed within said primary well downstream of said primary well and upstream of said primary main fuel supply nozzle, and said secondary air bleed path system supplying bleed air into fuel-air mixture formed within said secondary well downstream of said secondary well and upstream of said secondary main fuel supply nozzle.

4. An air/fuel ratio control system according to either one of claims 1 and 2, said carburetor further comprising a primary well within which fuel is maintained at a first predetermined fuel level, a secondary well within which fuel is maintained at a second predetermined fuel level, a primary air bleed tube protruding into said primary well below said first predetermined fuel level and formed with a plurality of air bleed holes below said first predetermined fuel level, and a secondary air bleed tube protruding into said secondary well below said second predetermined fuel level and formed with a plurality of air bleed holes below said second predetermined fuel level, a flow of basic primary bleed air being admitted into said primary air bleed tube, and a flow of basic secondary bleed air being admitted into said secondary air bleed tube, fuel-air mixture formed within said primary well being supplied to said primary main fuel supply nozzle so as to be sucked therefrom into said primary intake passage by the depression in said primary intake passage when air is flowing through said primary intake passage, and fuel-air mixture formed within said secondary well being supplied to said secondary main fuel supply nozzle so as to be sucked therefrom into said secondary intake passage by the depression in said secondary intake passage when air is flowing through said secondary intake passage; said primary air bleed path system supplying bleed air into said primary air bleed tube to be added to said basic primary bleed air therein, and said secondary air bleed path system supplying bleed air into said secondary air bleed tube to be added to said basic secondary bleed air therein.

* * * * *